US009879402B2

(12) United States Patent
Smith

(10) Patent No.: US 9,879,402 B2
(45) Date of Patent: Jan. 30, 2018

(54) DISCONNECTABLE METHOD AND SYSTEM FOR SEAFLOOR MINING

(71) Applicant: Nautilus Minerals Pacific Pty Ltd, Milton, Queensland (AU)

(72) Inventor: Glen Smith, Milton (AU)

(73) Assignee: NAUTILUS MINERALS NIUGINI LIMITED, Port Moresby (PG)

( * ) Notice: Subject to any disclaimer, the term of this patent is extended or adjusted under 35 U.S.C. 154(b) by 0 days.

(21) Appl. No.: 14/367,750

(22) PCT Filed: Oct. 31, 2012

(86) PCT No.: PCT/AU2012/001332
§ 371 (c)(1),
(2) Date: Jun. 20, 2014

(87) PCT Pub. No.: WO2013/090976
PCT Pub. Date: Jun. 27, 2013

(65) Prior Publication Data

US 2015/0345292 A1 Dec. 3, 2015

(30) Foreign Application Priority Data

Dec. 23, 2011 (AU) ..... 2011905431

(51) Int. Cl.
*E02F 3/88* (2006.01)
*E21C 50/00* (2006.01)
(Continued)

(52) U.S. Cl.
CPC ..... *E02F 3/8866* (2013.01); *E02F 3/885* (2013.01); *E02F 3/90* (2013.01); *E02F 3/905* (2013.01);
(Continued)

(58) Field of Classification Search
CPC ... E02F 3/903; E02F 3/907; E02F 3/92; E02F 3/40; E02F 3/9212; E02F 3/90;
(Continued)

(56) References Cited

U.S. PATENT DOCUMENTS 3,522,670 A * 8/1970 Flipse et al. ..... 37/314
3,731,975 A * 5/1973 Lindelof ..... 37/317
(Continued)

FOREIGN PATENT DOCUMENTS

CA 1132616 A 9/1982
CN 101509379 A 8/2009
(Continued)

OTHER PUBLICATIONS

International Search Report for PCT/AU2012/001332, dated Feb. 27, 2014.
(Continued)

*Primary Examiner* — Robert Pezzuto
(74) *Attorney, Agent, or Firm* — McDonnell Boehnen Hulbert & Berghoff LLP

(57) ABSTRACT

A system for seafloor mining comprising a vertical riser anchored to the seafloor; a mining machine to deliver seafloor ore to the vertical riser; a lifting system to pass the ore through the vertical riser; and a transport vessel removably connected to the vertical riser to receive ore from the vertical riser.

19 Claims, 3 Drawing Sheets

(51) Int. Cl.
*E02F 7/10* (2006.01)
*E02F 3/90* (2006.01)
*E02F 7/06* (2006.01)

(52) U.S. Cl.
CPC ..... *E02F 7/065* (2013.01); *E02F 7/10* (2013.01); *E21C 50/00* (2013.01)

(58) Field of Classification Search
CPC ..... E02F 3/8808; E02F 3/8858; E02F 3/88; E02F 3/8875; E02F 3/8866; E02F 3/885; E02F 7/10; E02F 3/905; E02F 7/065; E21C 50/00; F04D 15/0083; F04D 15/0066
USPC ..... 37/195, 309, 314–318, 345; 299/1.9, 299/8–10
See application file for complete search history.

(56) References Cited

U.S. PATENT DOCUMENTS 4,030,216 A 6/1977 Willums
4,245,475 A * 1/1981 Girden ..... F03G 7/05 239/2.1
4,685,742 A * 8/1987 Moreau ..... 37/309
6,042,303 A * 3/2000 Head ..... E21B 17/015 166/359
8,173,012 B1 * 5/2012 Che ..... E21B 43/0122 166/357
8,657,531 B2 * 2/2014 Rios ..... E21B 17/015 405/158
2009/0284068 A1 * 11/2009 Yu ..... E02F 3/8858 299/1.9

FOREIGN PATENT DOCUMENTS

DE 2707899 A1 8/1978
GB 2103570 A 2/1983
JP 50-57002 5/1975
JP 05-239987 A 9/1993
JP 2000511250 A 8/2000
JP 2011520046 A 7/2011
WO 97018380 5/1997
WO 2009/136064 A1 11/2009
WO 2011/008834 A2 1/2011

OTHER PUBLICATIONS

Provost, M. "Disconnectable FPSO technology opens new markets in Gulf of Mexico" Offshore, Jun. 2008, vol. 68, No. 6, pp. 82-83.

* cited by examiner

DISCONNECTABLE METHOD AND SYSTEM FOR SEAFLOOR MINING

This application is a US national phase of International Application No. PCT/AU2012/001332 filed on Oct. 31, 2012, which claims priority to Australian Patent Application No. 2011905431 filed on Dec. 23, 2011. The entire disclosure contents of these applications are herewith incorporated by reference into the present application.

FIELD OF THE INVENTION

This invention relates to a method and associated system for seafloor mining. In particular, the invention relates to a method and associated system for deepwater seafloor mining in areas which are exposed to non-benign seastates and/or cyclonic (or similar) weather events. However, it should be appreciated that the method and system for seafloor mining may be used in sheltered waters or benign seastate locations.

BACKGROUND OF THE INVENTION

The deep sea contains many different resources available for extraction, including silver, gold, copper, manganese, cobalt, and zinc. These raw materials are found in various forms on the sea floor, usually in higher concentrations than terrestrial mines. However, most of these deposits are found in water having a, depth of between 1,000 and 6,000 meters. Therefore there are substantial technical challenges mining and transporting ore from the seafloor.

In order to mine the ore from the deposits, the applicant has developed a method and system for seafloor mining. The system includes a dynamically suspended subsea pump located at the bottom of a vertical riser that extends to a surface vessel. A combination of seafloor production tools excavate and deliver the mineralised ore in slurry form to the pump via a horizontal transport pipe. In use, the ore travels through the horizontal transport pipe, up through the riser and into the surface vessel. The ore is then dewatered and transferred to a barge.

The above method and system for seafloor mining is primarily for use in relatively calm ocean water. That is, the above method and system for seafloor mining is impractical or unfeasible in areas that are disposed to large wave height fluctuations especially evident in cyclone (or typhoon) prone, locations. This is largely due to riser sensitivity and to high riser dynamic loading and the seastate limitations associated with the transfer of ore from the mining support vessel to an adjacent barge.

The reference to any prior art in this specification is not, and should not be taken as, an acknowledgement or any form of suggestion that the prior art forms part of the common general knowledge in Australia.

OBJECT OF THE INVENTION

It is an object of the invention to overcome or alleviate one or more of the disclosures or provide the consumer with the useful or commercial choice.

SUMMARY OF THE INVENTION

In one form, although not necessarily the only or broadest form, the invention relates to a system for seafloor mining comprising:

a vertical riser anchored to the seafloor;

a mining machine to deliver seafloor ore to the vertical riser;

a lifting system to pass the ore through the vertical riser; and a transport vessel removably connected to the vertical riser to receive ore from the vertical riser.

The vertical riser is preferable in the form of a rigid riser. However, it is possible that the vertical riser is a flexible riser. It is also envisaged that the vertical riser may be formed from a rigid section and a flexible section.

At least one buoyancy device may be used to support the vertical riser. The buoyancy device may be in the form of a buoyancy tank. The buoyancy of the buoyancy tank may be varied.

The lifting system may be of any suitable form. The lifting system may be in the form of a subsea pump. The subsea pump is normally located adjacent a bottom of the vertical riser.

An alternative lifting system may use air to lift the ore through the vertical riser. The air may be pumped into the vertical riser. Sufficient air may be pumped into the vertical riser at a position to lift the ore. This position may be varied according to design. An air supply line may extend down the vertical riser to deliver air into the vertical riser. A compressor may be attached to the air supply line to enable air to travel through the air supply line.

The transport vessel may include a cargo hold for storage of the ore. The transport vessel may include a processing plant for de-aerating and/or dewatering the ore.

A jumper may be used to connect the mining machine to the vertical riser. The jumper may be connected to adjacent the bottom of the riser. A quick coupling may be used to connect the jumper to the mining machine.

A flexible link hose may be used to connect the vertical riser to the transport vessel. A quick coupling may be used to connect the jumper to the mining machine.

A support vessel may be used to control the operation of the mining machine. The support vessel may be linked to the mining machine via an umbilical.

The mining machine may be used to excavate ore to supply to the vertical riser. Alternatively, the mining machine may be used to retrieve already excavated ore and supply them to the vertical riser. It should be appreciated that more than one mining machine may be connected to the vertical riser.

In another form, the invention resides in a method for seafloor mining including the steps of:

connecting a mining machine from a vertical riser which is anchored to the seafloor; and connecting a transport vessel from the vertical riser.

The method may further include one or more of the steps of:

commencing operation of a lifting system;

lowering a mining machine from the seafloor.

disconnecting a mining machine from a vertical riser which is anchored to the seafloor;

disconnecting a transport vessel from the vertical riser;

discontinuing operation of a lifting system; and retrieving a mining machine from the seafloor.

BRIEF DESCRIPTION OF THE DRAWINGS

Embodiments of the invention, by way of example only, will now be described with reference to the accompanying figures in which.

DETAILED DESCRIPTION OF THE PREFERRED EMBODIMENT

Figure 1:
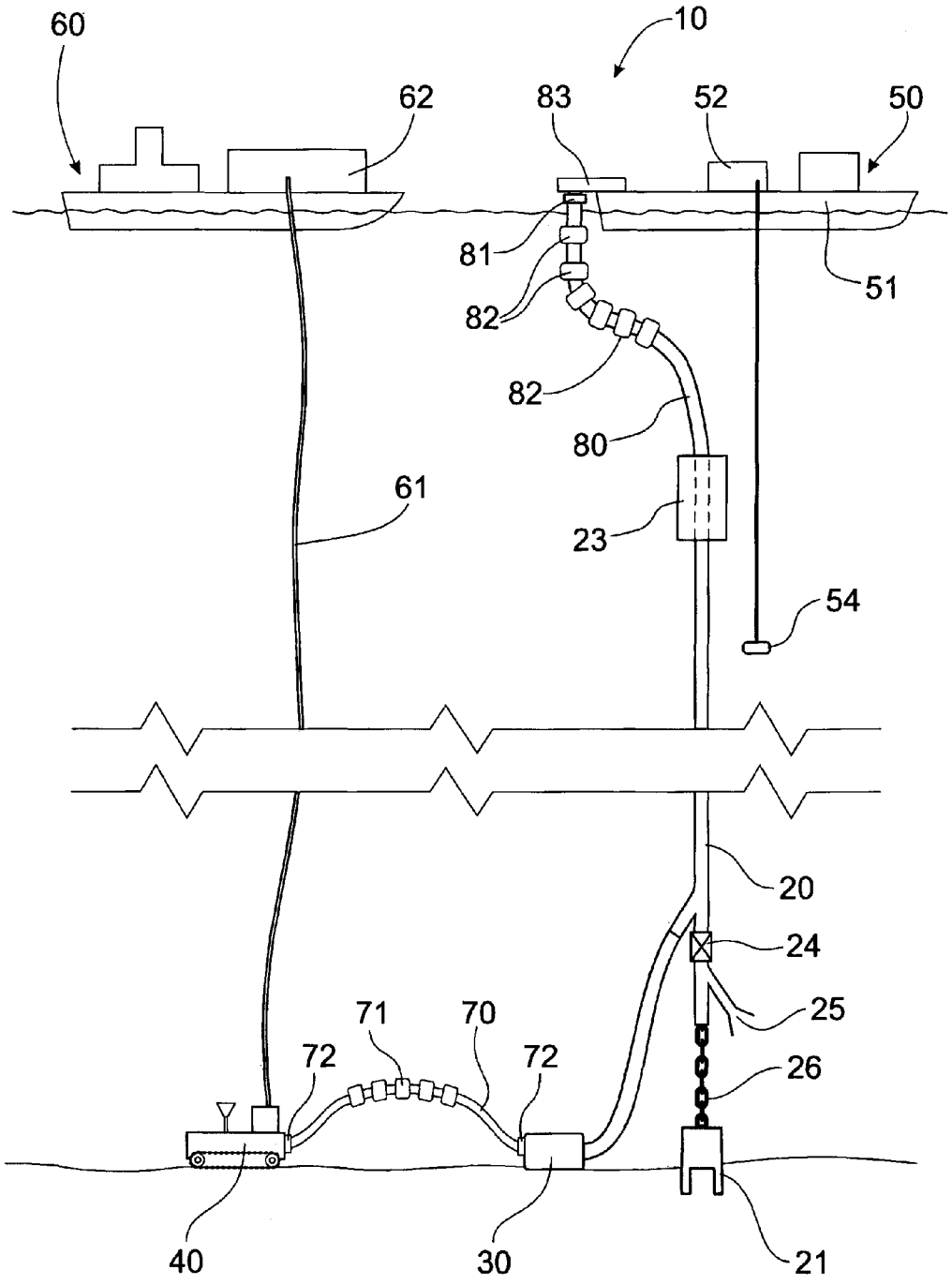
FIG. 1 is a schematic view of an operational system for seafloor mining according to a first embodiment of the invention.

FIG. 1 shows a system for seafloor mining 10 for use in areas which have large wave height fluctuations and/or are located in cyclone prone areas. However, it should be appreciated that the system 10 for seafloor mining may be used in low wave height areas. The system 10 includes a vertical riser 20, a subsea pump 30, a mining machine 40, a transport vessel 50 and a support vessel 60.

The vertical riser 20 is used to transport ore received from the mining machine 40 to the transport vessel 50. The vertical riser 20 is constructed from a rigid pipe which is anchored to the seafloor via an anchor 21. The anchor 21 can be in the form of a clump weight, piled foundation structure or an alternate vertically loaded foundation apparatus. A chain 26 or other suitable tether is normally used to attach the vertical riser 20 to the anchor 21. The type and size of the vertical riser 20 and would readily be chosen by a person skilled in the art depending on design requirements.

A dump valve 24 is located adjacent a bottom of the vertical riser 20. The dump valve 24 is used to ensure the vertical riser 20 does not become blocked during an uncontrolled shut down. In an uncontrolled shut down, the dump valve 24 is opened thereby releasing ore from vertical riser 20 through an outlet 25 located below the dump valve 24. It would be appreciated by a person skilled in the art that there are numerous ways in which the dump valve 24 is activated at an appropriate time.

A buoyancy tank 23 is attached to adjacent the top of the vertical riser 20. The buoyancy tank 23 is used to assist in maintaining the tension in the vertical riser 20. The positioning of the buoyancy device 23 is at a depth where the waves do not cause unacceptable loading or movement on the riser 20. Accordingly, the size and form of the buoyancy tank 23 would be evident to a person skilled in the art. The vertical riser 20 passes through buoyancy tank 23.

The buoyancy of the buoyancy tank 23 can be varied to allow relocation of the vertical riser 20. The buoyancy of the buoyancy tank 23 can be varied by varying the amount of water that is located within the buoyancy tank 23. Once mining at a site is completed, the buoyancy tank 23 is partially flooded to reduce the tension of the chain 26 between the vertical riser 20 and anchor 21. For such an operation, the riser 20 can be supported from surface by the transport vessel 50 or the support vessel 60 whilst the chain 26 at the base of the vertical riser 20 is disconnected from the anchor 21. Once the chain 26 has been removed, the vertical riser 20 can be relocated and connected to another anchor 21 at the next location. Air can then be added to the buoyancy tank to remove the water and allow the buoyancy tank to support the vertical riser 20.

The subsea pump 30 is used to pump the ore from the seafloor to the transport vessel 50. The subsea pump 30 is located adjacent the end of the vertical riser 20. The size and type of the subsea pump 30 will be dependant on design requirements which would be readily be assessed by a person skilled in the art. It should be appreciated that the means that is used to operate the pump could be varied. For example, the pump may be powered electrically or hydraulically, The mining machine 40 is used to mine the ore from the seafloor. The typical size of the seafloor which contains the ore is approximately 500 meters wide by 1000 meters long by about 10 to 40 meters deep. The seafloor terrain is generally very rugged. The water depth also ranges from 1,000 meters to 2,500 meters. The mining machine 40 may work on the rugged terrain with slopes as high as 25 degrees. Therefore, the mining machine 40 ideally would be designed to perform under these rugged deep sea conditions. The mining machine 40 could be designed to mine the ore by performing any combination of the following steps, including, but not limited to, (1) excavating the ore from the fields located on the seabed floor, (2) breaking down the ore into chunk sizes using a cutter mounted on the mining machine 40, and (3) forcing the ore into a crusher located on the mining machine to crush the ore into manageable sizes to ensure the ore passes through the vertical riser 20. It should be appreciated that the mining machine 40 may be used to simply collect ore that has been previously stockpiled so that the ore can be transferred to the transport vessel 50. Many variations and embodiments are envisioned for the mining machine 40.

It should be appreciated the system for mining may use a number of mining machines. These mining machines may have varying operations such as excavating ore, stockpiling ore and/or collecting ore from the stockpile. Further, there may be a number of different mining machines performing the same operation.

A jumper 70 is used to connect the mining machine 40 to the vertical riser 20 via the subsea pump 30. The jumper 70 may also be referred to as the horizontal transport pipe or a riser transfer pipe. The jumper 70 may be configured in an arced shape. This may reduce the force exerted by the subsea pump 30 on the mining machine 40. The other function of the arc shaped jumper 70 is to provide flexibility and range of movement of mining machine 40 relative to the vertical riser 20.

A large radius of the jumper 70 may lower the centrifugal force and wear. Jumper buoyancy devices 71, such as buoys are used to maintain the jumper in its arced state. A quick release coupling 72 may be located on one or more ends of the jumper to enable quick release of the jumper from the subsea pump 30 and/or mining machine 40. A remotely operated vehicle (ROV) (not shown) may be associated with the jumper 70 to enable the quick release (or connection) of the jumper 70 with the pump and/or mining machine 40.

The transport vessel 50 is used to store and transport ore that are removed from the seafloor. Accordingly, the transport vessel 50 includes a cargo hold 51 for placement of the ore. The transport vessel 50 also includes a processing plant 52 to both dewater and dewater the ore prior to their placement in the cargo hold 51. The wastewater from the processing plant 52 is pumped into the sea via a dewatering pipe 54 at a depth that does not have an unacceptable environmental impact. Alternatively, the wastewater is pumped into water injection lines (not shown) which may be piggy backed onto the vertical riser 20 to power a compression chamber of the pump 30 to lift the ore to the surface vessel.

The transport vessel 50 is attached to the vertical riser 20 via a flexible link hose 80. A quick release coupling 81 is located at the end of the hose to join the flexible link hose 80 to the transport vessel 50. A swivel 83 is located on the transport vessel 50, adjacent to the quick coupling 81, in order to allow rotation or "weathervaning" of the transport vessel 50. Hose buoys 82 are connected around the link hose 80 to enable surface retrieval of the flexible link hose 80. It should be appreciated that the buoy 82 may be used with other types of floating devices to enable retrieval of the flexible link hose 80 such as a floating rope.

The support vessel 60 is used to transport and support the mining machine 40. An umbilical 61 extends from the support vessel 60 to the mining machine 40 in order to control the operation of the mining machine 40 from the support vessel 60. The support vessel 60 includes deployment and retrieval equipment 62 to both place and retrieve the transport vessel 50 as is required.

The system 10 commences operation by running the subsea pump 30. Operation of the pump enables the mining machine 40 to excavate ore from the seafloor. It should be appreciated that movement of the mining machine 40 is controlled by an operator located within the support vessel 60. Once the ore passes through the mining machine 40, the ore then pass through the jumper 70, through the subsea pump 30 and into the vertical riser 20. The ore then pass through the flexible link hose 80 and into the onboard processing plant 52 located on the transport vessel 50. Once the water is removed from the ore, the ore is placed within the cargo hold 51.

In the event that the system for seafloor mining 10 is unable to continue operation due to wave height implications or simply the transport vessel 50 is full, then the flexible link hose 80 is de-coupled from the transport vessel 50 allow the transport vessel 50 to leave the location of the mine. The jumper 70 is also de-coupled from the mining machine 40 via the ROV. The placement and retrieval equipment 61 located on the support vessel 60 is utilised to remove the mining machine 40 from the seafloor. Once the mining machine 40 is removed from the seafloor, the support vessel 60 is able to travel to a safe location.

Figure 2:
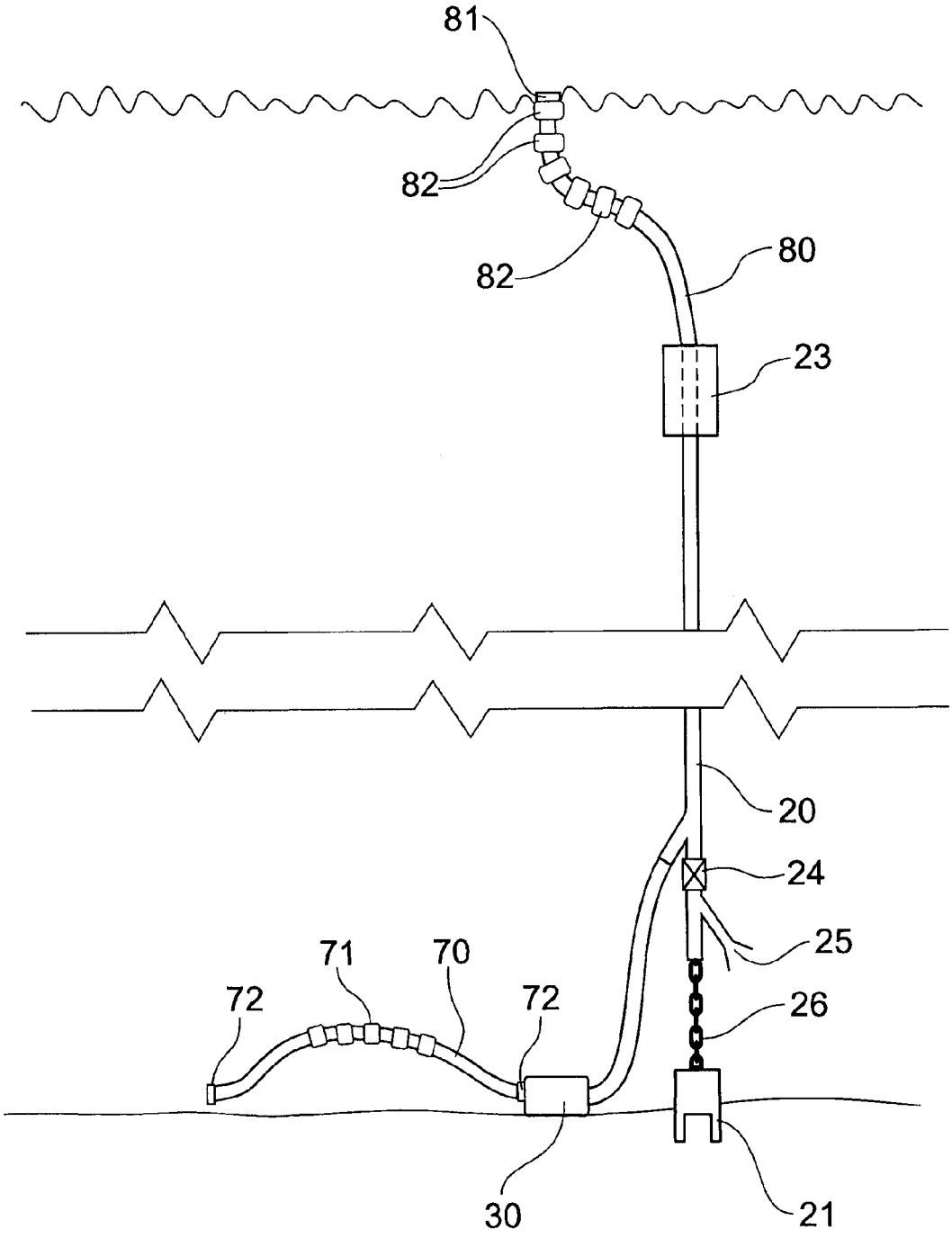
FIG. 2 is a schematic view of a non-operational system for seafloor mining.

During any large wave activity, the buoyancy device 23 and vertical riser 20 are positioned below any wave activity. Therefore, the vertical riser 20, buoyancy device 23, subsea pump 30 and jumper 70 can remain at the mining site during a storm as shown in FIG. 2.

In order to commence mining operations after an unacceptable storm event or seastate condition or simply to continue mining operations, both the support vessel and transport vessel 50 return to the site of the subsea mine. The transport vessel 50 retrieves the flexible link hose 80 and couples the flexible link hose 80 using the transport vessel 60 and the quick coupling 81. The support vessel deploys the mining machine 40 to the seafloor. The ROV is used to connect the jumper 70 to the mining machine 40. The mining operation can then commence.

It should also be appreciated that the advantages provided by the system 10 when wave heights implications become an issue also provide advantages in normal use. The quick disconnection of the transport vehicle 50 allows the transport vessel 50 to transport and/or discharge the ore in a reduced timeframe. That is, once its cargo hold is full, the transport vessel 50 disconnects from the flexible link hose 80 and transports the ore to an onshore stockpile or transfers the ore to a separate transportation vessel in sheltered waters. A further transport vessel 50 is then able to connect to vertical riser 20 via the link hose 80 to allow the continuation of mining operations.

The system 10 for mining the seafloor enables the quick removal of the mining machine 40, the transport vessel 50 and support vessel 60 when required. Further, the system 10 allows for increased production seastate limits and hence increased production time. Still further, the support provided for the vertical riser 20 reduces dynamic and fatigue loading. Lastly, the systems provides for no offshore transfer of ore between vessels.

Figure 3:
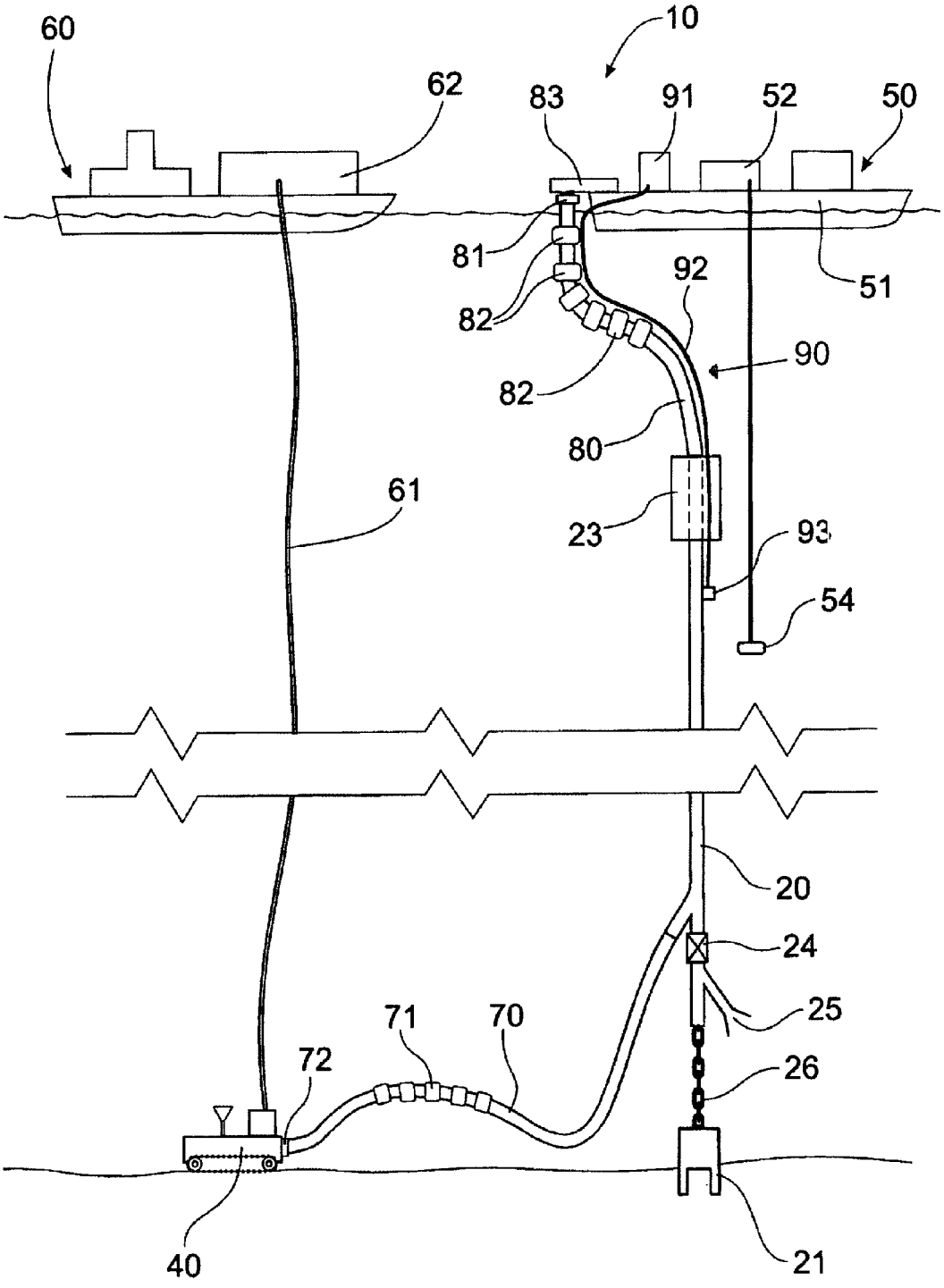
FIG. 3 is a schematic view of a system for seafloor mining according to a second embodiment of the invention.

FIG. 3 shows an alternative embodiment of the system 10 for seafloor mining. In this embodiment the pump 30 has been replaced with an air lift system 90. The air lift system 90 includes a compressor 91 which is mounted on the transport vessel 50. An air supply line 92 extends from the compressor 91, along the flexible link hose 80 and passes toward a bottom of the vertical riser 20. The air supply hose 92 extends through the vertical riser 20 via a nipple 93 to supply air within the vertical riser 20 in order to lift ore from seafloor. It should be appreciated that the placement of the supply line 92 within the vertical riser 20 and the size of the compressor 91 is dependant on design and would be able to be determined by a person skilled in the art.

In this specification, the terms "comprise", "comprises", "comprising" or similar terms are intended to mean a non-exclusive inclusion, such that a system, method or apparatus that comprises a list of elements does not include those elements solely, but may well include other elements not listed.

It will also be appreciated that various other changes and modifications may be made to the invention described without departing from the spirit and scope of the invention.

The invention claimed is:

1. A system for seafloor mining comprising:

an anchor located on a seafloor;

a vertical riser having a rigid section and a flexible section, the rigid section being releasably attached to the anchor and supported by a buoyancy device with variable buoyancy and the flexible section having one or more floating devices;

a mining machine to deliver seafloor ore to the vertical riser;

a lifting system to pass the ore through the vertical riser; and a transport vessel removably connected to the flexible section of the vertical riser to receive ore from the vertical riser.

2. The system of claim 1 wherein the buoyancy device is in the form of a buoyancy tank.

3. The system of claim 1 wherein the lifting system may be in the form of a subsea pump.

4. The system of claim 1 wherein the lifting system uses air to lift the ore through the vertical riser using a compressor.

5. The system of claim 1 wherein the transport vessel includes a cargo hold for storage of the ore.

6. The system of claim 1 wherein the transport vessel includes a processing plant for at least one of de-aerating and dewatering the ore.

7. The system of claim 1 wherein a flexible jumper is used to connect the mining machine to the vertical riser.

8. The system of claim 1 wherein a support vessel is used to control the operation of the mining machine.

9. The system of claim 1 wherein the vertical riser is releasably attached to the anchor via a chain.

10. A method for seafloor mining including the steps of:

connecting a mining machine to deliver seafloor ore to a vertical riser having a rigid section and a flexible section, wherein the rigid section is releasably attached to an anchor located on the seafloor and supported by a buoyancy device with variable buoyancy and the flexible section has one or more floating devices; and connecting a transport vessel from the vertical riser.

11. The method of claim 10 further including the step of: commencing operation of a lifting system.

12. The method of claim 11 further including the step of: lowering a mining machine to the seafloor.

13. The method of claim 12 including the step of: disconnecting a transport vessel from the vertical riser.

14. The method of claim 13 further including the steps of: disconnecting a mining machine from the vertical riser which is releasably attached to the anchor; and discontinuing operation of the lifting system.

15. The method of claim 14 further including the step of: retrieving the mining machine from the seafloor.

16. The method of claim 15 further including the step of: varying the buoyancy of the buoyancy device by varying an amount of water that is located within the buoyancy device.

17. The method of claim 16 further including the step of: disconnecting the riser from the anchor.

18. The method of claim 17 further including the steps of: relocating the riser; and connecting the riser to another anchor at another location.

19. The method of claim 18 further including the step of: opening a dump valve to release ore from the vertical riser through an outlet located below the dump valve.

* * * * *